US005460553A

United States Patent [19]

Craig et al.

[11] Patent Number: 5,460,553

[45] Date of Patent: Oct. 24, 1995

[54] JET PUMP MOUNTING SYSTEM

[75] Inventors: W. Scott Craig; Clarence E. Blanchard, both of Kenosha, Wis.; Charles B. Hall, Ingleside, Ill.; Duane E. Rogers, Kenosha, Wis.; Robert Mooney, Oak Creek, Wis.

[73] Assignee: Outboard Marine Corporation, Waukegan, Ill.

[21] Appl. No.: 147,933

[22] Filed: Nov. 5, 1993

[51] Int. Cl.[6] ..... B63H 11/00

[52] U.S. Cl. ..... 440/38; 440/47; 440/89

[58] Field of Search ..... 440/38, 39, 40, 440/47, 53, 112, 113, 88, 89; 60/221; 114/345, 357, 151

[56] References Cited

U.S. PATENT DOCUMENTS

| | | | |
|---|---|---|---|
| 3,840,319 | 10/1974 | Rhoda . | |
| 3,868,833 | 3/1975 | Noe et al. | 440/38 |
| 3,942,464 | 3/1976 | Schoell | 60/221 |
| 3,982,496 | 9/1976 | Blanchard . | |
| 4,023,353 | 5/1977 | Hall . | |
| 4,040,378 | 8/1977 | Blanchard . | |
| 4,679,522 | 7/1987 | Nishida . | |
| 4,781,141 | 11/1988 | Webb et al. . | |
| 5,123,867 | 6/1992 | Broinowski | 440/38 |
| 5,177,764 | 6/1992 | Kretzer, Jr. . | |

OTHER PUBLICATIONS

Brunswick Corporation, "Sport Jet 90 Installation Manual," 1993, pp. 1–24.

Coles, et al., "Seloc's Personal Watercraft," vol. I, pp. 10–7, 10–20, 10–21, published 1991.

*Primary Examiner*—Stephen Avila

*Attorney, Agent, or Firm*—Greer, Burns & Crain, Ltd.

[57] ABSTRACT

A system for mounting a jet propulsion unit to a watercraft having a hull with a mounting opening, the jet propulsion unit including a power head and a jet pump housing secured to the power head, the mounting system including a power transmission portion disposed on the jet pump housing, and a mounting apparatus associated with the transmission portion for mounting the propulsion unit directly to the hull.

2 Claims, 4 Drawing Sheets

JET PUMP MOUNTING SYSTEM

RELATED APPLICATIONS

This application is related to copending, commonly-assigned applications entitled: ADAPTOR PLATE MOUNTING SYSTEM FOR JET PROPULSION UNIT, Ser. No. 08/147,880, filed Nov. 5, 1993, MARINE PROPULSION UNIT HAVING EXTERIORLY ACCESSIBLE CLEAN-OUT CAPABILITY AND FLUSHING DEVICE FOR SAME, Ser. No. 08/142,976, filed Nov. 5, 1993, abandoned, and JET PUMP EXHAUST SYSTEM, Ser. No. 08/147,973, filed Nov. 5, 1993.

BACKGROUND OF THE INVENTION

The present invention relates generally to marine jet propulsion units, and specifically to systems for mounting relatively higher-powered, marine jet propulsion into multi-passenger watercraft, particularly where the propulsion units employ indirect drive systems.

Conventional marine jet propulsion units are designed to be used instead of propeller-driven outboard or inboard marine motors. Some of the more significant advantages of jet propulsion units include the lack of a depending gear case, which allows the craft to have minimum contact with the water surface at high speed. This feature of jet propulsion units enables the operator to make tight turns while maintaining the boat in a generally horizontal orientation. Another feature of marine jet propulsion units is that the lack of a depending propeller enables the craft to be operated in shallower water without fouling.

A significant design criterion for mounting such jet propulsion units to watercraft hulls is the need to secure the unit to the hull in a manner which minimizes the transmission of power unit and/or gear train vibrations through the hull. Another design factor relates to the need to easily mount the power unit into the hull, which is an operation normally performed by the boat builder in a location remote from the point of manufacture of the propulsion unit.

One conventional jet propulsion unit is mounted to a hull having a mounting platform elevated from the base of the hull to define a channel. A generally rectangular mounting opening is defined in the mounting platform. The power head is mounted to a drive housing cover disposed above both the mounting platform and the channel. The drive housing cover thus overlaps the mounting opening in the mounting platform. A drive housing is secured to an underside of the drive housing cover, and is located below the platform and within the channel. A main elastomeric grommet circumscribes the drive housing at the platform level and is sandwiched between the drive housing cover and the platform primarily to prevent the entry of ambient water into the power head area. Another function of the grommet is to isolate power head and drive housing vibrations from the hull. The lower end of the drive housing is covered by a ride plate which in turn is isolated from the hull by an elastomeric seal to keep the channel watertight.

A disadvantage of such an arrangement is that since the power head is still directly mounted to the drive housing, the amount of vibration generated by these two components may still tend to overcome the isolating capabilities of the main resilient grommet. It has been found that the major source of vibration is the power head, rather than the gear train portion of the drive housing, which is a further disadvantage of the conventional arrangement. Another disadvantage of such an arrangement relates to the rather complicated procedure required for assembling the jet propulsion unit at the same time it is mounted to the hull.

Another design factor of jet propulsion units relates to the fact that to proceed in the reverse direction or "back up", the normally rearwardly directed high pressure propulsion stream of water is directed at a depending angle and generally towards the bow of the craft. This stream is also often directed in the general area of the water intake of the propulsion unit. To prevent cavitation and/or starvation of the jet propulsion impeller due to an excessive amount of entrained exhaust gas in the intake flow, care must be taken to avoid the presence of gas near the intake. Since conventional jet propulsion units emit the engine exhaust at or just below the water surface near the jet outlet, when the unit is placed in reverse, the potential is created for exhaust being emitted into the water and pushed forward toward the water intake by the jet stream.

Thus, an object of the present invention is to provide a mounting system for a jet propulsion unit wherein power head and jet pump housing vibrations are effectively isolated and prevented from being transmitted to the hull.

Another object of the present invention is to provide a mounting system for a jet propulsion unit which is readily installed in the hull of the watercraft.

Still another object of the present invention is to provide a mounting system for a jet propulsion unit wherein the exhaust gases are prevented from entering the water intake when the craft is placed in reverse.

SUMMARY OF THE INVENTION

Accordingly, the above-identified objects are met or exceeded by the present jet pump mounting system, in which the jet propulsion unit is secured to the watercraft so that the power head and jet pump housing are mounted as a unit to the hull. The power head is vibrationally isolated from the jet pump housing as well as the hull. In one embodiment, the lower end of the jet pump housing is attached directly to the bottom of the hull. In another embodiment, the jet pump housing is circumscribed by an elastomeric grommet to further isolate the hull from vibrations generated by the propulsion unit. The grommet preferably receives the clamping force generated through fastening the jet pump housing to the hull to maximize the isolation of vibrations.

Another feature of the present mounting system is the inclusion of a rearwardly projecting ride plate which intercepts and deflects exhaust gases from the jet propulsion stream when the craft travels in reverse. The construction of the ride plate thus prevents the intake of exhaust gas by the jet pump unit.

More specifically, the present mounting system is designed for mounting a jet propulsion unit to a watercraft having a hull with a mounting opening, wherein the jet propulsion unit includes a power head and a jet pump housing configured for the mounting of the power head thereto. The mounting system includes a mounting apparatus associated with the jet pump housing for attaching the jet pump housing directly to the hull. Thus, the power head, and the jet propulsion unit as a whole, is secured to the hull only at the jet pump housing.

In another embodiment, the present jet pump mounting system is provided for mounting a jet propulsion unit to a watercraft having a hull with a mounting opening. The jet propulsion unit includes an impeller housing secured to the jet pump housing. The impeller housing has exhaust ports disposed in operational relationship thereto for emitting exhaust gases generated by the power head. Also included is an exhaust deflector apparatus for deflecting the exhaust gases.

In still another embodiment, a watercraft configuration is provided with a specific opening in the hull for receiving the jet propulsion unit. More specifically, a watercraft is disclosed which is adapted for accommodating a jet propulsion unit having a power head and a jet pump housing. The watercraft includes a hull with a base and a transom wall and a generally "L"-shaped mounting opening dimensioned to accommodate a portion of the jet propulsion unit. The opening has a substantially horizontal portion defined by the base and a substantially vertical portion defined by the transom wall.

DESCRIPTION OF THE PREFERRED EMBODIMENT

Figure 1:
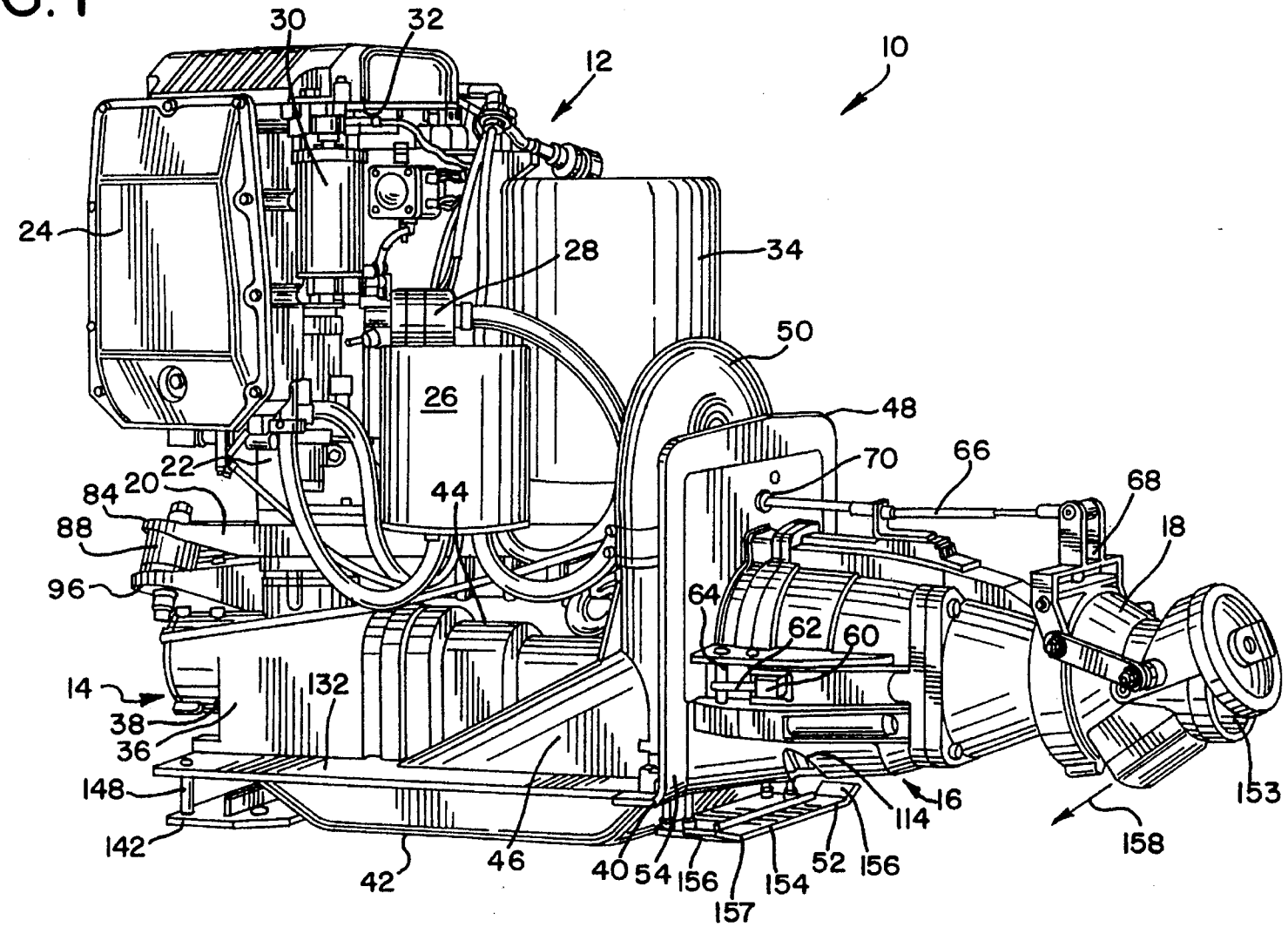
FIG. 1 is a perspective elevational view of a marine power head and jet pump assembly employing the present exhaust system.

Referring now to FIG. 1, a marine jet propulsion unit of the type suitable for use with the present exhaust system is generally designated 10. The unit 10 is designed for mounting inboard fashion into the hull of a watercraft, preferably a multi-passenger boat. However, the use of the present propulsion unit with other appropriate watercraft is contemplated. Major components of the propulsion unit 10 are a power head or engine 12, and a pump unit 14 which includes an impeller housing 16, a reverse gate 18 connected to the impeller housing 16, and an adaptor plate 20 disposed between the power head 12 and the pump unit 14.

The power head 12 in the preferred embodiment is a conventional three cylinder, two-cycle marine power unit including an engine block 22, an air silencer device 24, a fuel pump 26, a fuel filter 28 connected to the fuel pump, an electric starter 30 connected to a flywheel assembly 32, and a muffler 34. In the preferred embodiment, the power head 12 is capable of generating in the range of 70–90 horsepower, although power units of both smaller and larger power ratings and having a variety of cylinder configurations are suitable for use with the present jet propulsion unit.

Referring now to the pump unit 14, also known as the jet pump housing, the unit includes a housing 36, also referred to as a gear housing, having a fore end 38, an aft end 40, an underside 42 and an upper surface 44. Included in the underside 42 is a water intake grille (not shown) which communicates with a water intake passage or conduit located at 46. At the aft end 40 is found a transom plate 48 which is integrally formed with the housing 36, as by casting, and a flexible exhaust hose 50. A ride plate 52 is mounted to the underside 42 of the housing 36, and is located in vertically spaced, depending relationship relative to a lower end 54 of the transom plate 48. A portion of the hull 56 of the watercraft to which the present unit 10 is mounted is sandwiched between a portion of the ride plate 52 and the underside 42 of the housing 36 (best seen in FIG. 2).

The impeller housing 16 is releasably connected to the gear housing 36 by a pair of diametrically opposed clips 60 which each include a hook portion 62 constructed and arranged to engage a post 64 secured to an aft end of the transom plate 48. A gear shift cable 66 is connected to the reverse gate 18 through a linkage 68 and passes through a grommeted aperture 70 in the transom plate 48.

Figure 2:
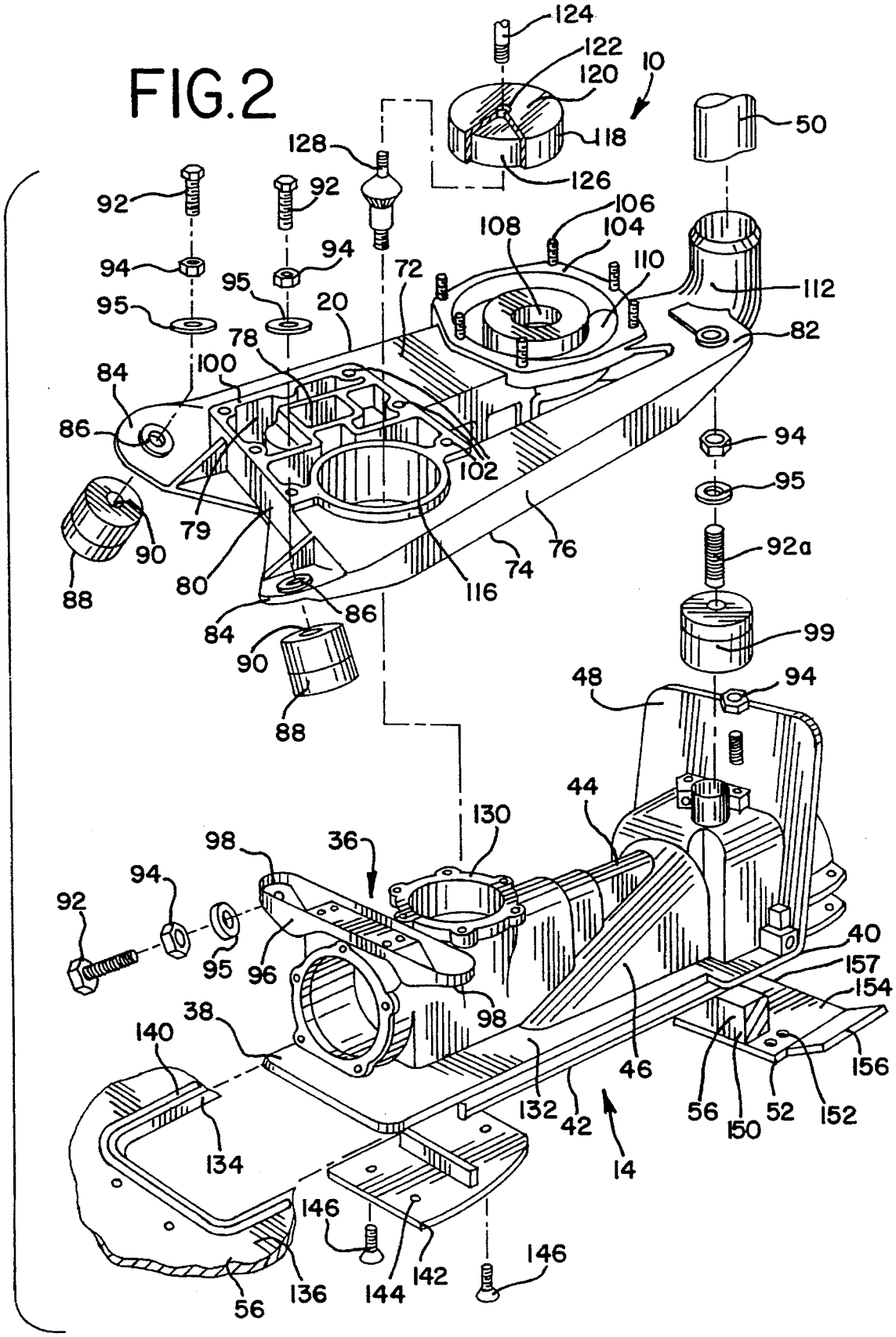
FIG. 2 is an exploded fragmentary perspective view of the pump unit of FIG. 1.

Referring now to FIG. 2, the adaptor plate 20 is shown exploded away from the pump unit 14. Although having a generally planar or relatively flattened configuration, the adaptor plate 20 is basically a cast hollow component, having a generally planar upper surface 72, a lower surface 74 and a sidewall 76. The sidewall 76 defines an internal space or passageway 78 and maintains the lower surface 74 in vertically spaced relationship from the upper surface 72.

Included on the plate 20 is a fore end 80 and an aft end 82 corresponding to the fore and aft ends 38, 40 of the gear housing 36. At the fore end 80 of the plate 20 are located a pair of mounting ears 84, each provided with a throughbore 86, and each ear and throughbore form an adaptor plate mounting bracket. An elastomeric, resilient bushing 88 is provided for each of the mounting ears 84. Each bushing 88 has an internally threaded upper sleeve 90 and a corresponding lower sleeve (not shown). A threaded fastener 92, locknut 94 and washer 95 are preferably employed to lockingly secure the plate 20 to each of the bushings 88. However, other equivalent fastener assemblies are contemplated. In the preferred embodiment, the longitudinal axes of the bushings 88 intersect at a point above the center of gravity of the power head 12. This arrangement has been found to substantially increase the isolation of power head vibrations.

At the fore end 80 of the plate 20, the bushings 88 are secured to the gear housing 36 by an engine mount arm 96 fixed to the fore end of the housing and having an opposed pair of angled pockets or seats 98. Each seat 98 is dimensioned to accommodate one of the bushings 88, which is secured therein by a threaded fastener, locknut and washer assembly 92, 94 and 95. Each bushing 88 is thus disposed between one of the ears 84 and one of the bushing pockets 98. A rear bushing 99 is secured at the aft end 82 of the adaptor plate 20 using a threaded stud-type fastener 92*a*, a locknut 94 and a washer 95 to provide a three-point attachment of the adaptor plate to the pump housing 36.

Moving toward the aft end 82 from the ears 84, the plate 20 further includes a crankcase mounting point 100 configured to receive the power head 12. The power head 12 is secured to the mounting point 100 by threaded fasteners (not shown) which engage a plurality of mounting apertures 102 on the mounting point 100. The mounting point 100 is in fluid communication with the passageway 78 to receive exhaust gases emitted by the power head 12. It will be appreciated that the power head 12 is designed to be cooled by circulating ambient water, and that the adaptor plate is placed in fluid communication with the cooling galleries of the power head 12 through the cooling ports 79 which surround the passageway 78.

Further towards the aft end 82 is located a muffler attachment 104 including a plurality of attachment studs 106, a centrally located exhaust outlet 108 in communication with the power head 12 through the passageway 78, and a peripherally disposed exhaust inlet 110. The muffler 34 is attached to the studs 106 and is in fluid communication with the exhaust outlet 108 and the inlet 110. An exhaust conduit 112 located at the aft end 82 receives exhaust from the exhaust inlet 110, and is in turn connected to the exhaust hose 50 which ultimately passes exhaust out the exhaust ports 114 (best seen in FIG. 1). It is contemplated that the exhaust ports 114 may be integral with the impeller housing 16 or may be disposed next to or in otherwise operational relationship with the impeller housing.

The plate 20 further includes a generally vertically oriented transmission throughbore 116 dimensioned to accommodate an elastomeric drive coupler 118 having at a first end 120 an open-bottomed metallic shell with a threaded upper aperture 122 for receiving a power head drive shaft or crankshaft 124 in positive engagement. It is noteworthy here that the present unit 10 is used with power heads 12 having vertically oriented crankshafts 124, as opposed to conventional, generally horizontally oriented crankshafts. However, it is contemplated that the present mounting arrangement may be used with all types of jet propulsion units.

At a second or bottom end 126, the coupler 118 is provided with an elastomeric core which is secured within the metallic shell, and is configured to drivingly accommodate a corresponding end of a gear shaft 128. Since the coupler 118 is of the type having a resilient rubber-like core, it assists in the isolation of the gear housing 36 from power head vibrations. Thus, power in the form of rotational energy from the power head 12 is transmitted through the crankshaft 124, through the resilient core of the coupler 118 and through the shaft 128.

The drive coupler 118 is in substantial registry with an upper opening 130 of the gear housing 36 into which the gear shaft 128 projects for engagement with the coupler. For vibration dampening, the coupler 118 does not contact, but merely is disposed in, the transmission throughbore 116. A main impeller drive shaft (not shown) is connected to the shaft 128 and transmits the rotational energy to the impeller housing 16. The gear housing 36, the coupler 118 and the gear shaft 128 thus define a power transmission portion of the propulsion unit 10.

Figure 3:
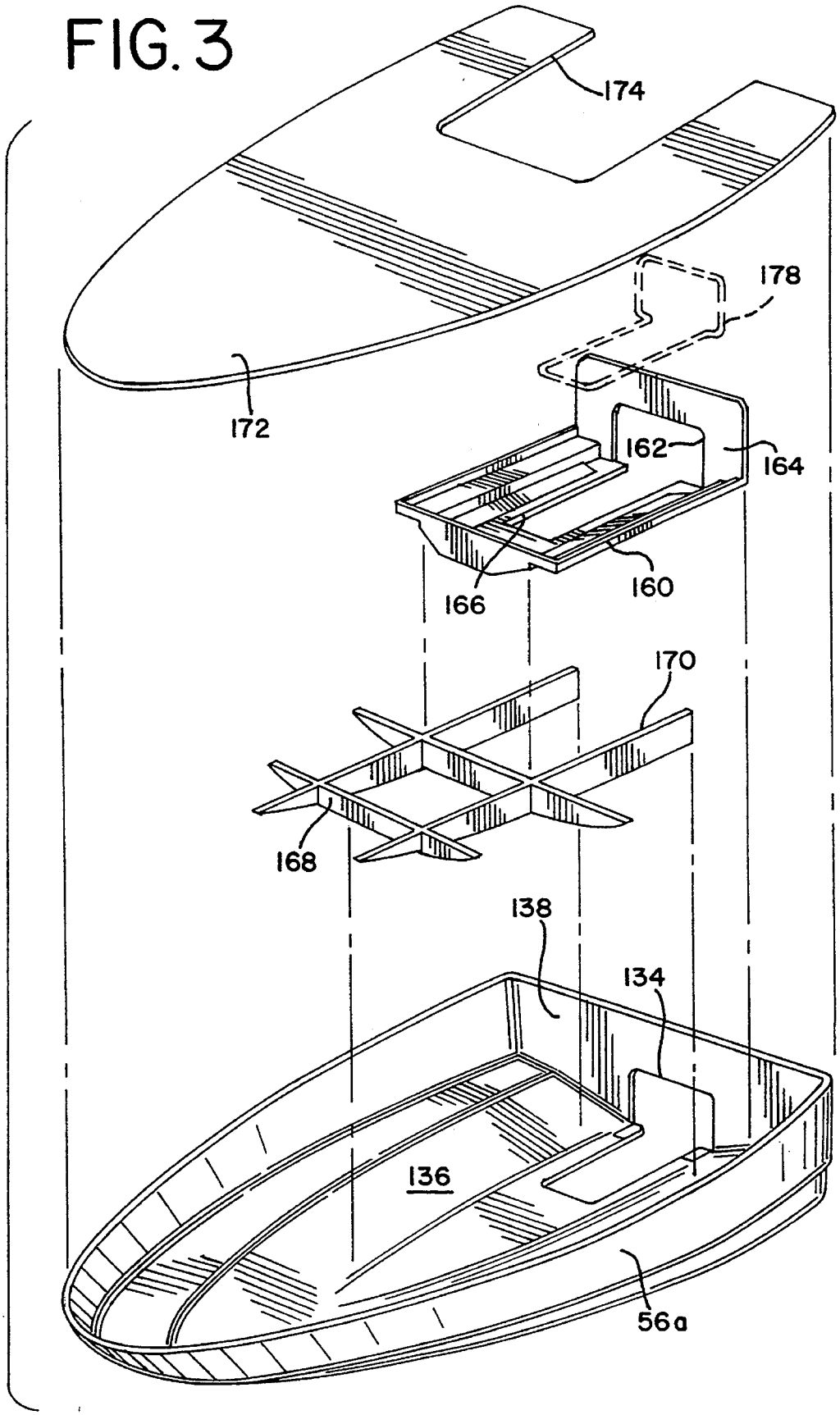
FIG. 3 is an exploded perspective elevational view of a type of boat construction suitable for use with the present mounting system.

Referring now to FIGS. 2 and 3, at the lower end of the gear housing 36 is found a laterally projecting flange 132, which in the preferred embodiment, is configured to rest upon the hull 56 as the point of contact between the jet propulsion unit 10 and the hull. Thus, the power head 12 is secured to the hull only through the plate 20 and the gear housing 36. Specifically, the hull 56 includes a generally "L"-shaped mounting opening 134 defined by a substantially horizontal hull base 136 and a substantially vertical hull transom wall 138. The flange 132 rests upon the margin of the opening 134 defined by the hull base 136. The portion of the opening 134 defined by the transom wall 138 is dimensioned to accommodate the transom plate 48.

Prior to securing the gear housing 136 to the hull 56, it is preferred that a bead of high quality, gasoline and oil resistant marine sealer 140 (best seen in FIG. 2) be applied about the opening 134, both on the hull base and transom wall portions 136, 138 respectively. In portions of the opening 134, at least one clamping plate, such as a fore end clamping plate 142 is employed to sandwich the hull 56 to the fore end 38 of the gear housing 36. The clamping plate 142 includes at least one opening 144 through which a corresponding threaded fastener 146 is inserted for engagement with the sealer 140 and the flange 132.

In the preferred embodiment, the threaded fasteners 146 are inserted into rigid sleeves 148 (best seen in FIG. 1) located between the clamping plate 142 and the flange 132 and designed to prevent the fasteners from crushing the hull 56, which in most cases is fiberglass or a combination of fiberglass and rigid plastic foam or other materials. At the aft end 40 of the gear housing 36, the ride plate 52 is dimensioned to sandwich another portion of the hull 56 between the ride plate and the gear housing flange 132. The portion of the hull 56 which is clamped in this manner is designated 150. The ride plate 52 is also provided with at least one aperture 152 through which additional fasteners 146 engage the flange 132. Between the fore end clamping plate 142 and the ride plate 52 is the location where ambient water is drawn into the intake conduit 46 and transmitted to the impeller housing 16 to create propulsion in the form of a jet stream emitted from an outlet 153 (best seen in FIG. 1).

It will be seen from FIGS. 1 and 2 that an aft portion 154 of the ride plate 52 extends aft of the transom plate 48, and is generally horizontal, with an upwardly inclined vane 156 located on each lateral edge. The aft portion 154 is configured to receive exhaust gases emitted generally downward by the exhaust ports 114 and, using the vanes 156, deflects the exhaust away from the underside 42 of the gear housing 36 and the intake of the water conduit 46. Preferably, the aft portion 154 of the ride plate 52 includes an aft end 157 which extends aft of the exhaust outlet 114.

Thus, when the power unit 10 is placed in reverse by actuating the gear shift cable 66 to operate the reverse gate 18, the jet stream emitted from the reverse gate and indicated by the arrow 158 (best seen in FIG. 1) is directed at an angle generally downward and toward the fore end 38 of the housing 36. Water comprising the jet stream may then drawn into the intake conduit 46 without fear of also drawing in exhaust gases from the ports 114, which could cause water starvation of the impeller and/or damaging cavitation. Instead, the exhaust emitted from the ports 114 is intercepted by the ride plate 52 and deflected away from the jet stream 158.

The above-identified direct mounting of the jet propulsion unit 10 to the hull 56 is considerably less complicated than that required for conventional jet propulsion units, particularly those having power heads with vertically positioned crankshafts. A significant advantage of the present mounting system is that the power head 12 and pump unit 14, including the gear housing 36 are mounted to the hull as a unit. The power head 12 is vibrationally isolated from the jet pump unit 14. Further, the preferred type of hull 56 for the present jet propulsion unit 10 is produced by Boston Whaler, Inc. of Rockland, Mass. 02370. As is known to skilled practitioners in the boat building art, Boston Whaler produces a relatively thick hull on the order of 1.5 inches which is comprised of a buoyant rigid plastic foam encased by a fiberglass shell. However, other conventional hulls having equivalent thicknesses are contemplated as being suitable for use with the propulsion unit 10.

Referring now to FIG. 3, when the present jet propulsion unit 10 is mounted upon a standard fiberglass hull **56*a*, there may be a need to increase the thickness of the hull so that the distance between the underside 42 of the gear housing 36 and the flange 132 is taken up by the hull. To modify a standard hull to receive the unit 10, a mounting insert 160 may be provided with a mounting aperture portion 162 which is of identical dimension to the mounting opening 134, and which has a substantially vertical transom wall 164 and a substantially horizontal hull wall 166 which correspond respectively to the hull transom wall 138 and the hull base 136. The insert 160 has a wall thickness on the inner edge of the mounting aperture portion 162 which, when secured upon the hull 56*a***, will approximate the hull thickness of a Boston Whaler hull.

The mounting insert 160 is placed in registry above the mounting opening 134, and is supported on the hull 56 by a support stringer 168, which is preferably a lattice made of elongate members of lightweight, rigid material such as wood or plastic. The insert 160 fits within an opening 170 defined by the stringer 168, and the assembled insert 160, stringer 168 and hull 56 are secured together with resin, adhesive and/or suitable fasteners, as is well known in the art. A floor 172 having an aft cutout 174 for accommodating the jet propulsion unit 10 is placed over the insert 160 and the stringer 168 and fastened thereto with resin, adhesive and/or suitable fasteners.

Figure 4:
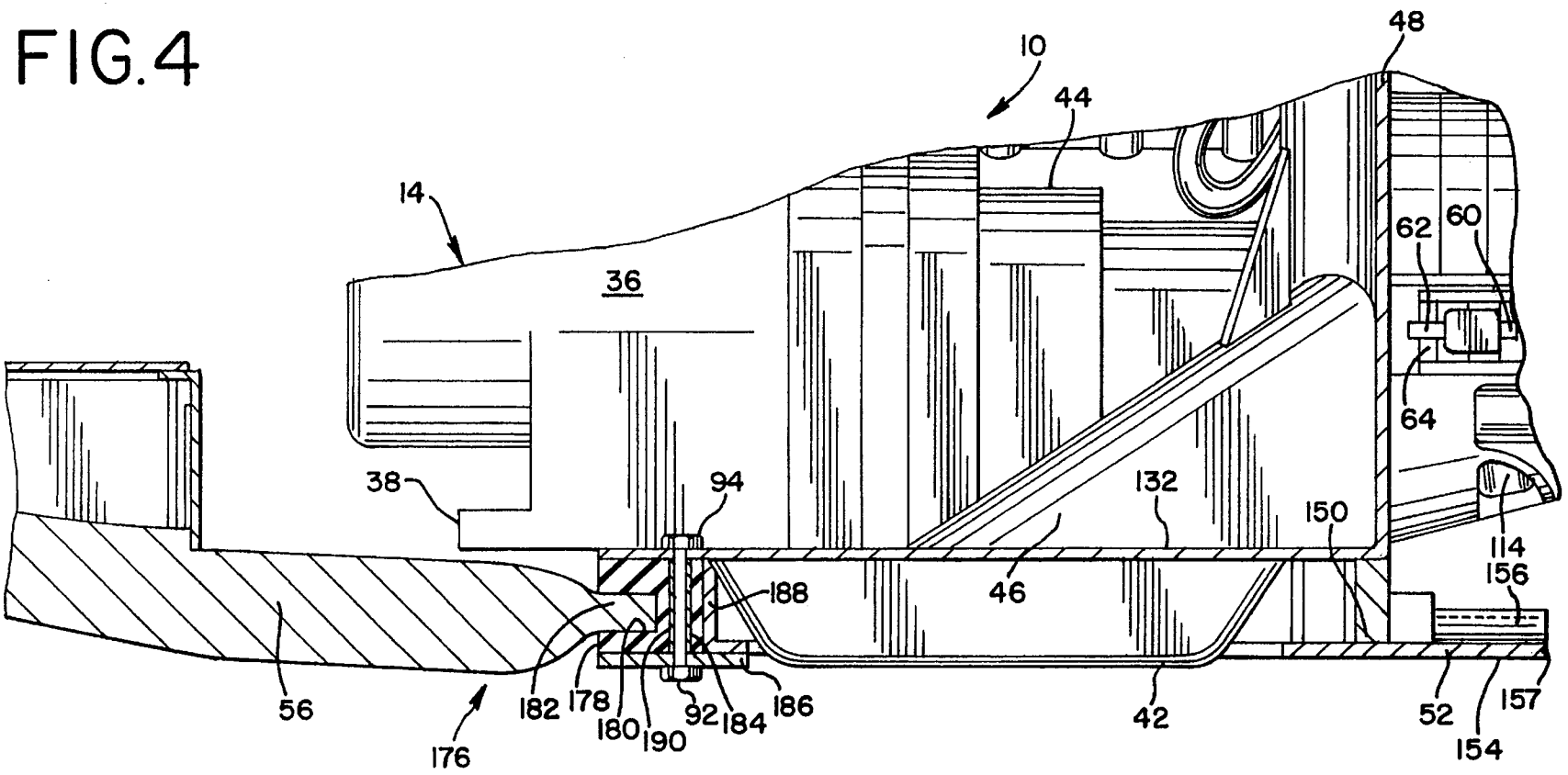
FIG. 4 is a vertical sectional view of an alternate embodiment of the present mounting system.

Referring now to FIG. 4, an alternate embodiment of the present mounting system is generally designated 176. Those components of the system 176 which are identical to those of the embodiments of FIGS. 1–2 have been designated with identical reference numerals. Instead of the jet propulsion unit 10 being secured directly to the hull 56 only through the direct attachment of the gear housing 36 to the hull, as in FIGS. 1–2, in the system 176, additional vibrational isolation is provided by a mounting opening grommet 178 which preferably circumscribes the entire opening 134. The grommet 178 is preferably made of a resilient, durable, water and chemical resistant material, and is provided with a laterally opening groove 180. An edge 182 of the hull 56 which defines the opening 134 is narrowed to provide a tight tongue-in-groove friction fit with the groove 180 of the grommet 178. In the preferred embodiment, the edge 182 is narrowed from a hull thickness of approximately 1.5 inches to a thickness on the order of ⅜ inch, although other hull thicknesses and edge thicknesses are contemplated depending on the specific application. The grommet 178 is also provided with a throughbore 184 which is perpendicular to the longitudinal axis of the groove 180.

Upon positioning the grommet 178 about the edge 182, the unit 10 is lowered into the hull 56 so that the flange 132 rests upon the grommet. The clamping plate 142 is replaced with a shortened pressure plate 186 which is coextensive along a fore-aft axis with the grommet 178 and with a depending bracket 188 of the gear housing 36. The bracket 188 depends from the housing a distance which is less than the distance between the underside 42 and the flange 132 so that a compressive force may be exerted upon the grommet to clamp the edge 182 within the groove 180. In addition, the depending distance of the bracket 188 reflects the need for the plate 186 to be substantially flush with the underside 42.

A threaded fastener 92 is inserted through an opening in the plate 186, through the throughbore 184 in the grommet 178 and through an opening in the flange 132. A locknut 94 secures the fastener 92 to the gear housing 36. If desired, a metallic or otherwise rigid sleeve 190 may be inserted into the throughbore 184 to prevent overtightening of the fastener and excessive compression of the grommet 178.

Although only a portion of the grommet 178 is shown in FIG. 4, the basic outline of the grommet is indicated in phantom in FIG. 3. The grommet 178 is attached in similar fashion to the transom plate 48 and the hull transom wall 138 as it is to the gear housing flange 132. In this manner, the jet pump housing is circumscribed by the grommet 178.

Thus, the present mounting system for a jet propulsion unit facilitates the attachment of the unit to a watercraft, in that the power head and the pump unit are mounted as an assembly directly to the hull. The operational vibrations generated by the power head are substantially isolated by the bushings 88 and 99. A further feature of the present system is that, in cases where vibrations generated by the pump unit are objectionable, the grommet 178 may be employed for further isolation of vibrations. In addition, the extended and vaned configuration of the ride plate 52 intercepts exhaust gases before they can be drawn into the water intake conduit 46 when the craft is operated in reverse.

While a particular embodiment of the jet pump mounting system of the invention has been shown and described, it will be appreciated by those skilled in the art that changes and modifications may be made thereto without departing from the invention in its broader aspects and as set forth in the following claims.

What is claimed is:

1. A system for mounting a jet propulsion unit to a watercraft having a hull with a mounting opening and a rear edge, the jet propulsion unit including a power head secured to a jet pump housing, said mounting system comprising:

an impeller housing associated with said jet pump housing and having exhaust ports disposed in operational relationship thereto for emitting exhaust gases generated by the power head;

exhaust deflector means associated with said jet pump housing for deflecting said exhaust gases;

a water intake associated with said jet pump housing; and said exhaust deflector means including a fixed ride plate with a portion disposed externally of and in spaced relation to said exhaust ports, said plate being secured in close proximity to, and extending beyond the rear edge of, said hull to intercept said exhaust gases and deflect said gases away from said water intake.

2. The mounting system as defined in claim 1 wherein said ride plate has an aft edge which is aft of said exhaust outlet.

* * * * *